US005822954A

United States Patent [19]

Osti et al.

[11] Patent Number: 5,822,954

[45] Date of Patent: Oct. 20, 1998

[54] METHOD AND UNIT FOR FOLDING PACKING BLANKS ALONG PREFORMED BEND LINES

[75] Inventors: Roberto Osti, Zola Predosa; Fiorenzo Draghetti, Medicina, both of Italy

[73] Assignee: G.D Societa' Per Azioni, Bologna, Italy

[21] Appl. No.: 807,710

[22] Filed: Feb. 28, 1997

[30] Foreign Application Priority Data

Mar. 1, 1996 [IT] Italy ..... BO96A0097

[51] Int. Cl.[6] ..... B65B 11/00

[52] U.S. Cl. ..... 53/466; 53/234; 53/586

[58] Field of Search ..... 53/466, 586, 234, 53/232, 575, 207

[56] References Cited

U.S. PATENT DOCUMENTS

| | | | |
|---|---|---|---|
| 2,945,334 | 7/1960 | Perrault | 53/228 |
| 4,036,117 | 7/1977 | Davies et al. | 93/51 |
| 4,144,695 | 3/1979 | Seragnoli | 53/234 |
| 4,208,854 | 6/1980 | Seragnoli | 53/575 |
| 4,628,664 | 12/1986 | Price | 53/232 |
| 4,711,065 | 12/1987 | Focke | 53/170 |
| 4,962,628 | 10/1990 | Boldrini | 53/462 |
| 5,133,173 | 7/1992 | Draghetti | 53/466 |
| 5,193,328 | 3/1993 | Boriani | 53/466 |
| 5,392,586 | 2/1995 | Imai | 53/234 |
| 5,533,323 | 7/1996 | Osti | 53/466 |

FOREIGN PATENT DOCUMENTS

| | | |
|---|---|---|
| 0174591 | 3/1986 | European Pat. Off. . |
| 0553636 | 8/1993 | European Pat. Off. . |
| 2225564 | 6/1990 | United Kingdom . |

*Primary Examiner*—John Sipos
*Assistant Examiner*—James P. Calve
*Attorney, Agent, or Firm*—Ladas & parry

[57] ABSTRACT

A method and unit for folding packing blanks along preformed bend lines defining, on each blank, a central panel, and two lateral panels located on either side of the central panel and each having at least one foldable tab; a clamping device and a folding device being provided, and cooperating with each other to fold the lateral panels and the respective tab while maintaining the respective blank clamped in a folding position in which the central panel of the blank is clamped rigidly between a plate of the clamping device and a large lateral surface of a product to be packed by means of the blank.

14 Claims, 4 Drawing Sheets

METHOD AND UNIT FOR FOLDING PACKING BLANKS ALONG PREFORMED BEND LINES

BACKGROUND OF THE INVENTION

The present invention relates to a method of folding packing blanks along preformed bend lines.

The present invention may be used to advantage on cigarette packing machines, to which the following description refers purely by way of example.

Cigarette packing machines are known to form packages substantially in the form of a rectangular parallelepipedon about respective products, each comprising a group of cigarettes enclosed in a foil wrapping, from respective flat blanks, each having preformed bend lines defining on the blank an intermediate portion and two lateral portions on either side of the intermediate portion. Each lateral portion comprises a lateral panel connected to the intermediate portion along a respective preformed bend line—hereinafter referred to as the "primary bend line"; and at least one foldable tab extending from and connected to the respective lateral panel along a respective preformed bend line—hereinafter referred to as the "secondary bend line."

On known packing machines, each blank is folded about the respective product using a method involving a given number of successive steps, the first of which normally comprises positioning the blank with the intermediate portion facing a folding seat, and, by means of movable folding mandrels, folding the two lateral panels partly into a U about the respective primary bend lines and onto respective beveled input edges of the folding seat.

The above method presents several drawbacks, mainly due to the fact that, despite the folding mandrels partly rotating the lateral panels about the primary bend lines, the initial rigidity at least of the blanks results in curving of the central portion. Since rotation of the lateral panels is normally completed by inserting the product and the blank inside the folding seat, i.e. using the product as a reaction element, such curving may therefore result in damage to the product as it is inserted inside the folding seat.

SUMMARY OF THE INVENTION

It is an object of the present invention to provide a method of folding packing blanks along preformed bend lines, designed to overcome the aforementioned drawbacks.

According to the present invention, there is provided a method of folding packing blanks along preformed bend lines defining, on each blank, an intermediate portion, two lateral portions on either side of the intermediate portion, and, for each lateral portion, a lateral panel and at least one foldable tab; the intermediate portion comprising a central panel connected to the lateral panels along said bend lines; the method comprising the steps of feeding a blank and a respective product for packaging in time with each other to a prefolding station; and folding said lateral panels onto respective small lateral surfaces of the product; and the method being characterized by also comprising the further steps of clamping said blank in a given folding position in which said central panel is positioned contacting a respective large lateral surface of the respective product; and keeping the blank in said folding position in the course of said folding step.

The present invention also relates to a unit for folding packing blanks along preformed bend lines.

According to the present invention, there is provided a unit for folding packing blanks along preformed bend lines defining, on each blank, an intermediate portion, two lateral portions on either side of the intermediate portion, and, for each lateral portion, a lateral panel and at least one foldable tab; the intermediate portion comprising a central panel connected to the lateral panels along said bend lines; the unit comprising supply means for feeding a blank and a respective product for packaging in time with each other to a prefolding station; and folding means for folding said lateral panels onto respective small lateral surfaces of the product; and the unit being characterized by comprising clamping means located at said station, and for clamping said blank in a given folding position in which said central panel is rigidly clamped between the clamping means and a large lateral surface of the respective product.

BRIEF DESCRIPTION OF THE DRAWINGS

A non-limiting embodiment of the present invention will be described by way of example with reference to the accompanying drawings, in which.

DETAILED DESCRIPTION OF THE INVENTION

Figure 1:
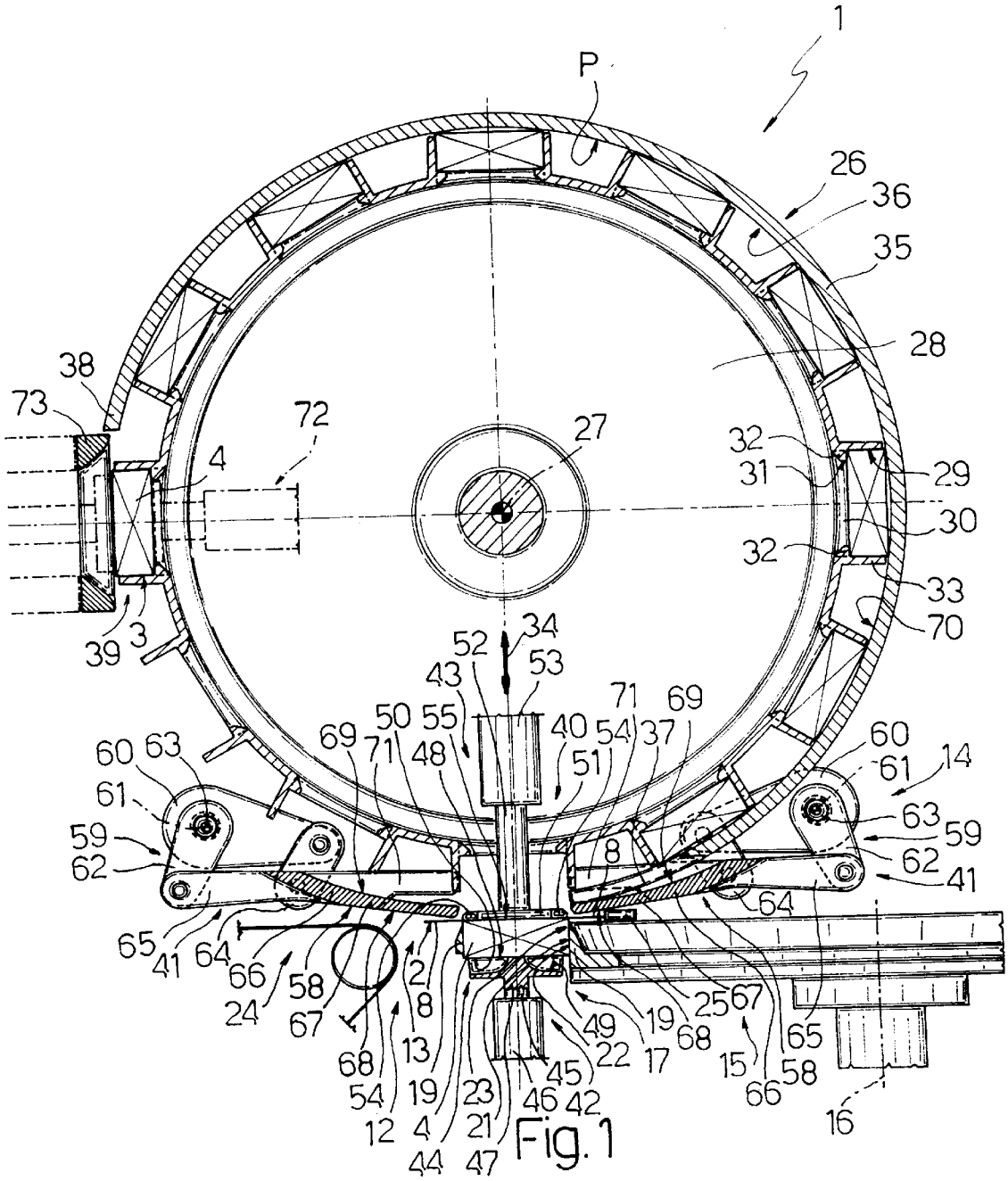
FIG. 1 shows a front view, with parts in section and parts removed for clarity, of a preferred embodiment of a blank folding unit in accordance with the present invention.
Figure 2:
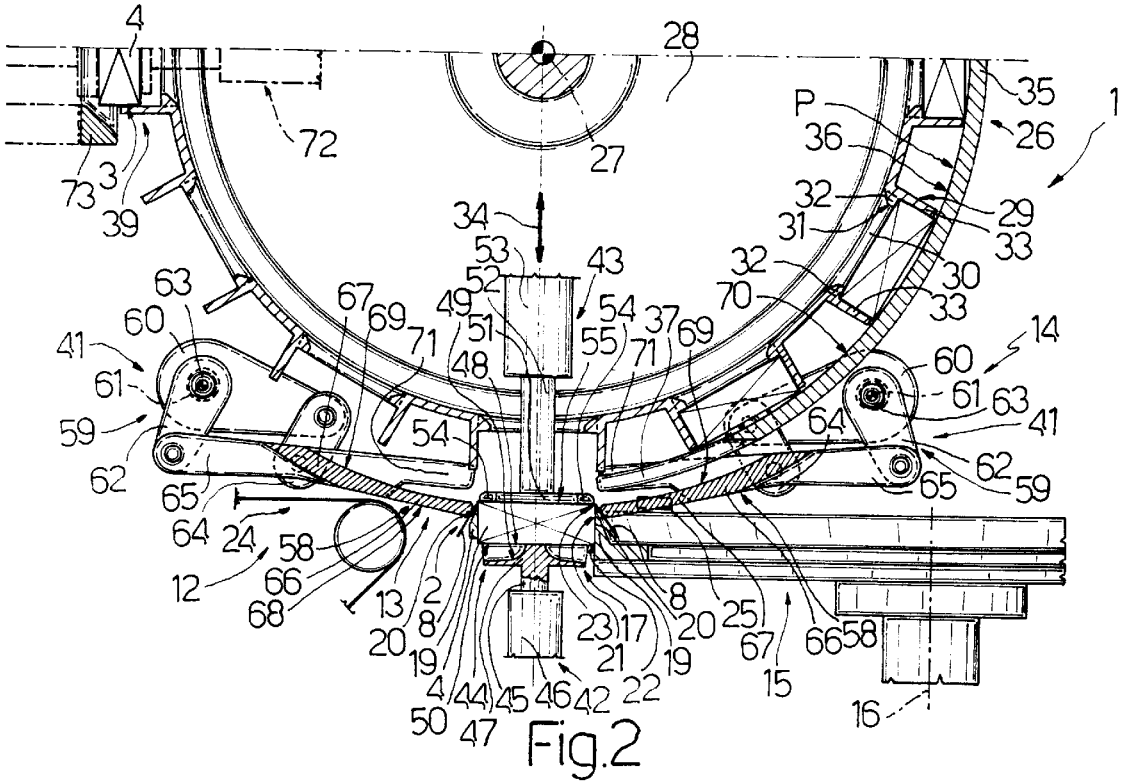
FIGS. 2, 3 and 4 show the FIG. 1 unit in respective operating positions.
Figure 3:
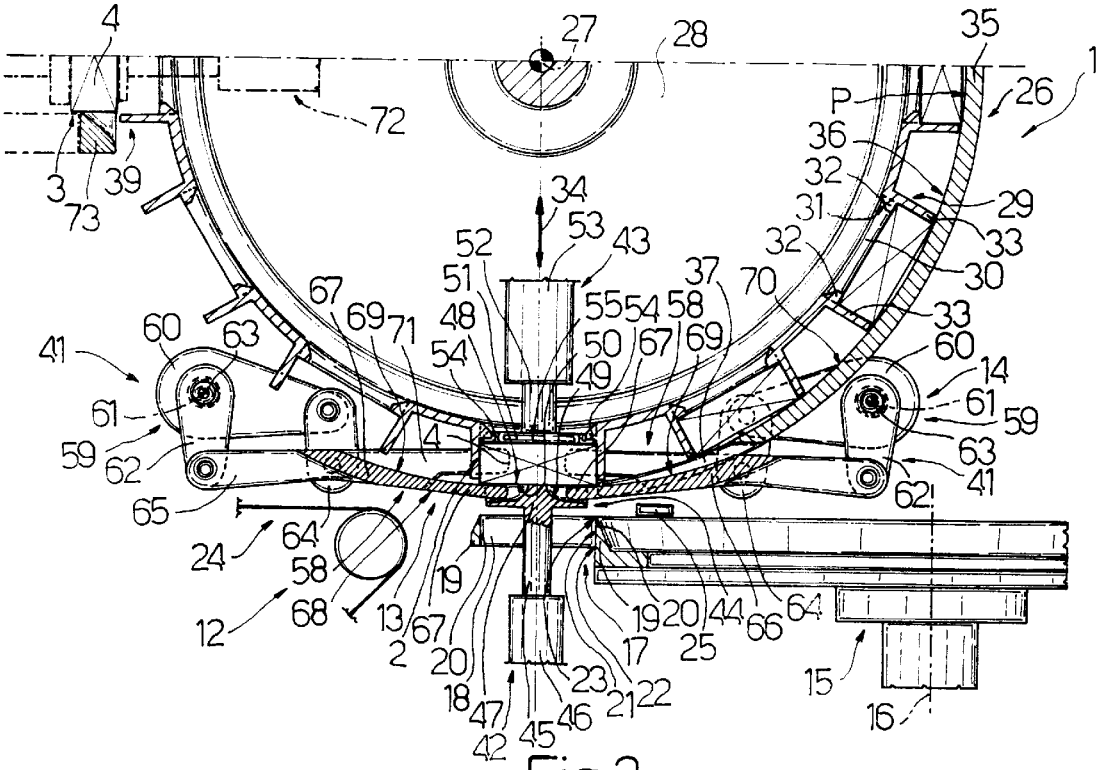
Figure 4:
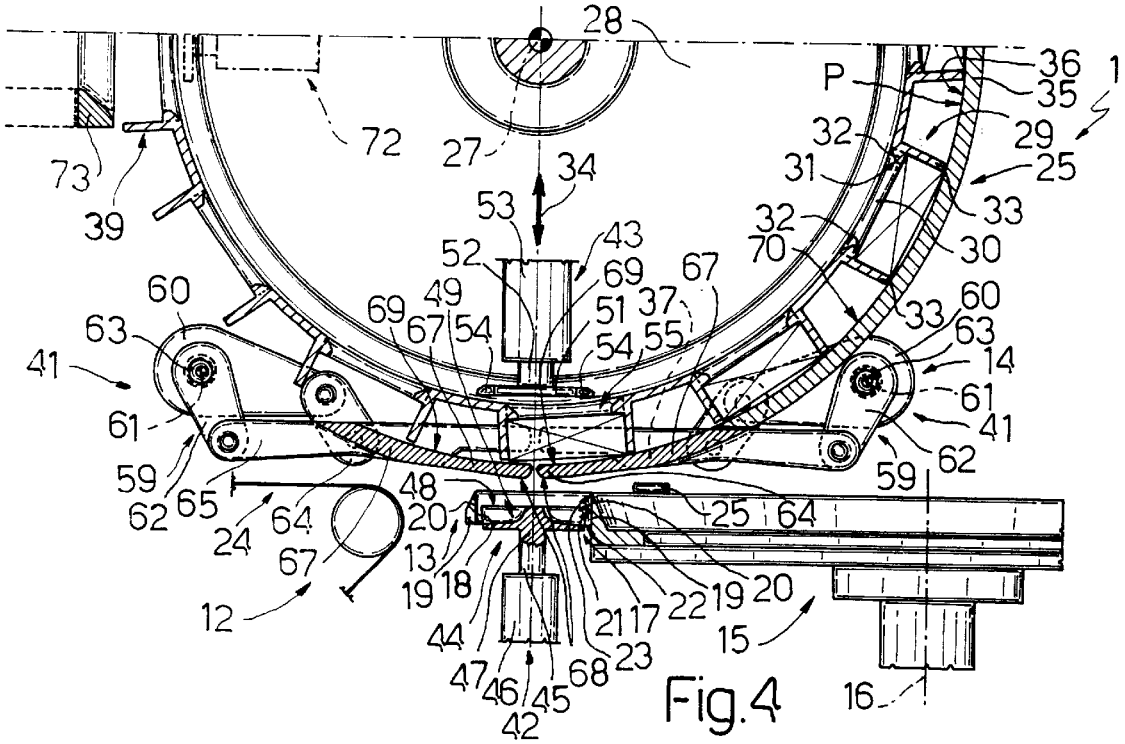

Number 1 in FIG. 1 indicates a unit for folding blanks 2 by which to form a package 3, substantially in the form of a rectangular parallelepipedon, about a product 4 comprising, in the example shown, a group of cigarettes (not shown) wrapped in a respective sheet of foil wrapping material (not shown).

Figure 6:
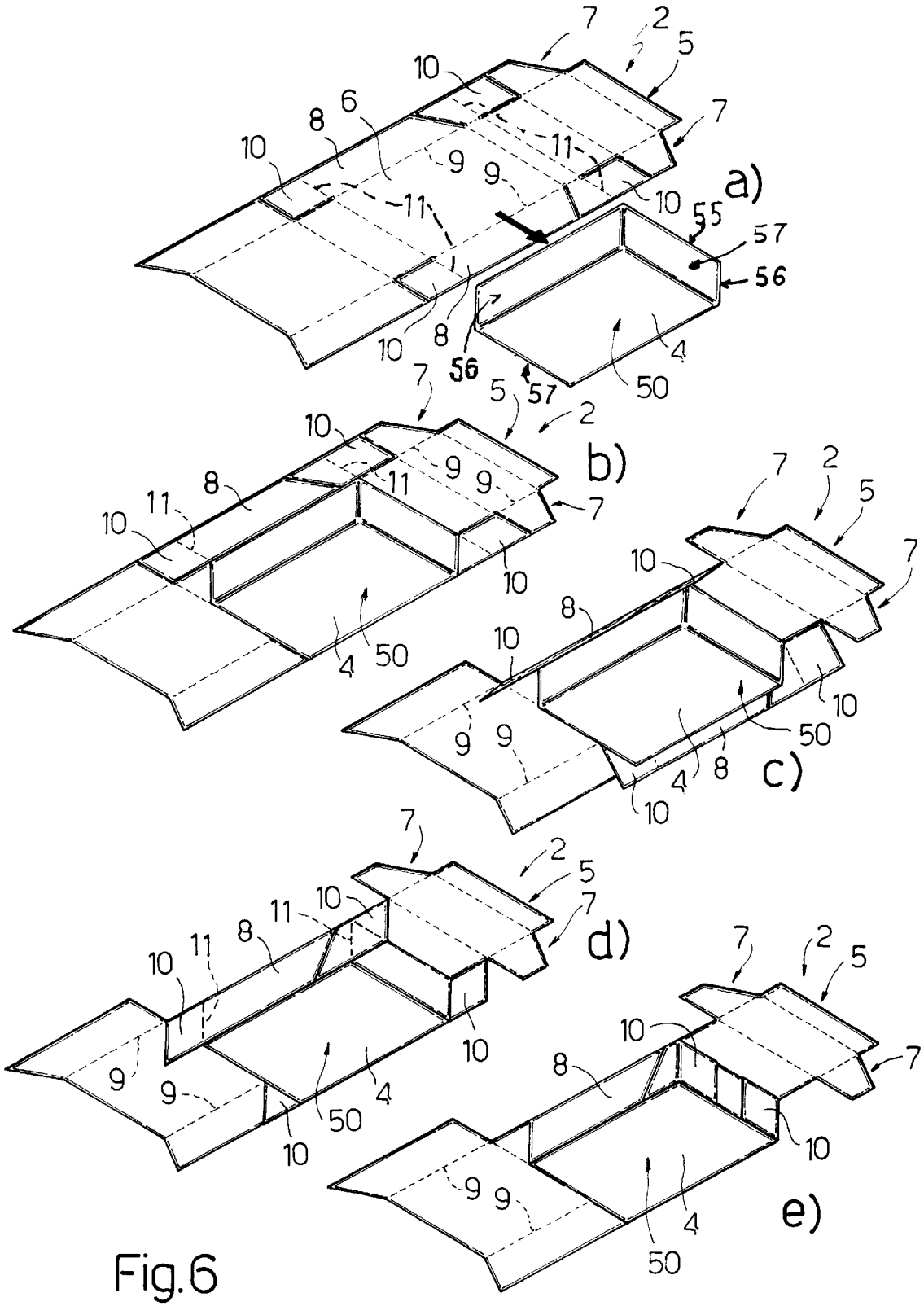
FIG. 6 shows a schematic view in perspective of a blank used on the FIG. 1 unit.

As shown more clearly in FIG. 6, blank 2 comprises a longitudinal intermediate portion 5, which, when folded, defines two large lateral walls and two end walls of package 3, and which in turn comprises a central panel 6 for defining one of said two large lateral walls. Blank 2 also comprises two longitudinal lateral portions 7 located on either side of intermediate portion 5.

Each lateral portion 7 in turn comprises a respective lateral panel 8 connected to panel 6 along a respective longitudinal primary bend line 9, and which, when folded, defines an inner portion of a respective small lateral wall of package 3; and two foldable tabs 10 which are connected to panel 8 along respective secondary bend lines 11 crosswise to respective line 9, and extend laterally with respect to intermediate portion 5, at opposite ends of respective lateral panel 8. As explained in detail later on, tabs 10 are folded squarely about respective secondary bend lines 11 to define inner portions of said end walls of package 3.

With reference to FIGS. 1 to 4, unit 1 comprises a supply assembly 12 for successively feeding blanks 2 of the above type and respective products 4 in time with blanks 2 to a prefolding station 13; and folding means comprising a folding assembly 14 located at station 13 and for receiving blanks 2 and products 4 at station 13 to form packages 3 about respective products 4.

Supply assembly 12 comprises a supply wheel 15 rotating in steps about a respective axis 16 of rotation, and having a number of peripheral supply pockets 17 (only one shown)

equally spaced about axis 16 and fed in steps through station 13 by wheel 15. Each pocket 17 is defined by a substantially rectangular frame having two small lateral walls 18 extending substantially radially outwards of wheel 15, and two large lateral walls 19 crosswise to walls 18 and having respective beveled outer edges 20. Walls 18 and 19 define a seat 21 for housing a respective product 4, and having a rear opening 22 by which to insert product 4 inside seat 21, and a front opening 23 by which to expel product 4.

Assembly 12 also comprises a known belt conveyor 24 for feeding blanks 2, crosswise to respective bend lines 9, to station 13, and for positioning blanks 2 against a fixed locater 25 at station 13. More specifically, at station 13, each blank 2 is positioned by conveyor 24 in a prefolding position (FIGS. 1 and 6*b*) in which blank 2 faces opening 23 of a respective pocket 17 arrested in station 13, so that bend lines 9 of blank 2 are positioned on respective end portions of edges 20, panel 6 is positioned substantially contacting product 4 housed inside seat 21, and lateral panels 8 are positioned facing respective edges 20.

Folding assembly 14 comprises a packing wheel 26 rotating anticlockwise (in FIG. 1) in steps about a respective axis 27 crosswise to axis 16, and in turn comprising a central drum 28 coaxial with axis 27, and a number of folding pockets 29 fitted to drum 28, equally spaced about axis 27, and fed in steps along an annular folding path extending about axis 27 and through station 13 to each receive, at station 13, a product 4 and respective blank 2.

Each pocket 29 is substantially U-shaped, and comprises a bottom wall 30 connected to drum 28 and having a central opening 31 with longitudinal comblike edges 32; and two lateral walls 33 extending perpendicularly from wall 30 and outwards of drum 28. Each pocket 29 is arrested by wheel 26 at station 13, so that, in use, pocket 29 is aligned with a pocket 17, also arrested in station 13, in a transfer direction 34 parallel to axis 16 and extending through axis 27.

Wheel 26 also comprises an annular plate 35, which extends along path P to define, with the periphery of drum 28, an annular channel 36 for the passage of pockets 29, and comprises an initial comblike end portion 37 extending towards station 13, and a final end portion 38 located downstream from station 13 along path P and at an unloading station 39 for unloading packages 3. Wheel 26 also comprises a number of known folding devices (not shown) located along path P and for completing, in known manner, the folding of blanks 2 about respective products 4 to form respective packages 3.

Assembly 14 also comprises transfer and clamping means comprising a device 40, which is movable through station 13 in direction 34 to transfer products 4 together with respective blanks 2 from seats 21 into pockets 29; and two folding devices 41 substantially similar to each other, located on either side of station 13, crosswise to direction 34, and for folding lateral panels 8 and tabs 10 squarely about respective primary and secondary bend lines 9 and 11.

Transfer device 40 comprises a pusher 42 and a counter-pusher 43, which are located on either side of station 13 in direction 34, respectively outwards and inwards of path P, and which cooperate with each other to clamp blank 2 in said prefolding position, and to expel product 4 from respective pocket 17 and feed product 4, together with respective blank 2, into respective pocket 29.

Figure 5:
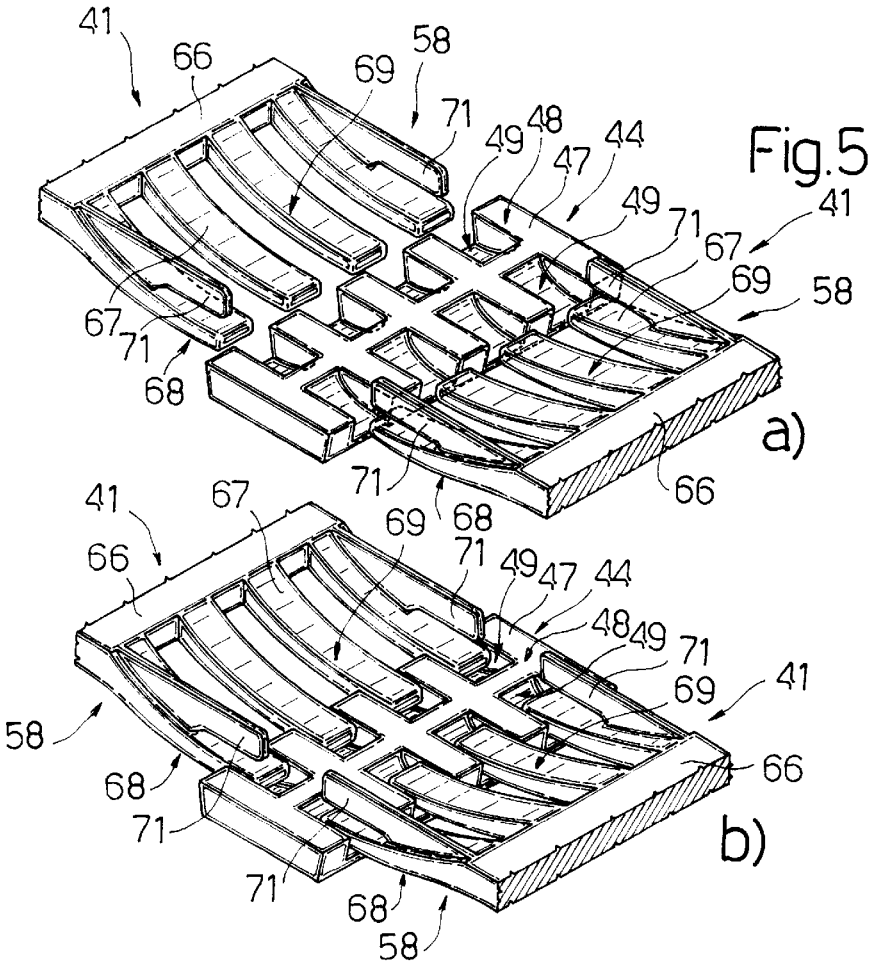
FIG. 5 shows a larger-scale, partially sectioned view of a FIG. 1 detail in two operating positions.

Pusher 42 comprises a head 44 connected to the end of the output rod 45 of a linear actuator 46, and which, as shown clearly in FIG. 5, in turn comprises a central body 47 defined, on the opposite side to that connected to rod 45, by a flat surface 48, and having a number of cavities 49 open both laterally and towards surface 48, so that the lateral portions of head 44 are substantially comblike.

By means of actuator 46, head 44 is moved in direction 34 between a withdrawn idle position (FIG. 1) in which surface 48 is substantially located at rear opening 22 of a pocket 17 arrested in station 13, and contacts a large lateral surface 50 of product 4 housed inside seat 21, and an extracted unloading position (FIG. 3) in which surface 48 is aligned with the end edges of walls 33 of pocket 29.

Counter-pusher 43 comprises a flat plate 51, which is connected to the end of the output rod 52 of a linear actuator 53, is parallel to surface 48, and in turn comprises two comblike longitudinal ends 54, which engage in sliding manner respective longitudinal edges 32 of opening 31 of a pocket 29 arrested in station 13.

By means of actuator 53, plate 51 is moved, in direction 34 and in push-pull manner with respect to head 44, between a withdrawn idle position (FIG. 4) in which plate 51 is located facing central opening 31 and outside pocket 29, and an extracted position (FIG. 1) in which plate 51 faces opening 23 of a pocket 17 arrested in station 13, and contacts central panel 6 of a blank 2 in said prefolding position, so as to clamp blank 2 between plate 51 and a further large lateral surface 55 of product 4 in turn clamped inside respective seat 21 by head 44.

The two folding devices 41 provide for partly folding lateral panels 8 of blank 2 clamped in said prefolding position between plate 51 and surface 55 of respective product 4, and for accompanying blank 2 in direction 34 from respective pocket 17 to respective pocket 29, so as to further fold panels 8 onto respective small lateral surfaces 56 of product 4 crosswise to surfaces 50 and 55, and to fold tabs 10 squarely onto respective end surfaces 57 of product 4 crosswise to surfaces 56.

Each device 41 comprises a manipulating and folding element 58; and an actuating device 59 for moving element 58 cyclically through a given number of folding positions (FIGS. 1–4) ranging between an end operating position (FIG. 4) in which elements 58 are positioned close to each other, and an intermediate operating position (FIG. 2) in which elements 58 are located on either side of a pocket 17 arrested in station 13.

Each device 59 is defined by an articulated quadrilateral with a movable frame, located in front of wheel 26, and comprising a movable plate 60 defining the frame of the articulated quadrilateral and fitted at one end to a drive shaft (not shown) to rotate about a fixed axis 61 parallel to axis 27 of wheel 26; a first crank 62 fitted to a respective drive shaft 63 coaxial with axis 61 and angularly free with respect to the aforementioned drive shaft; a second crank 64 fitted in rotary manner to a free end of plate 60; and a connecting rod 65 fitted in rotary manner to the free ends of of cranks 62 and 64 and supporting element 58.

As shown in FIG. 5, element 58 comprises a comblike plate 66 extending crosswise from connecting rod 65, and having a number of teeth 67 parallel to one another and to connecting rod 65, and which are inserted in sliding manner inside respective cavities 49 of head 44, and inside initial comblike end portion 37 of plate 35 as elements 58 are moved between said folding positions.

Teeth 67 are defined at the bottom by a substantially curved surface 68, which cooperates with lateral panels 8 and respective tabs 10 of blank 2, and, at the top by a surface 69 having the same curvature as an inner surface 70 of annular plate 35, so that surface 69 is aligned with surface 70 when, in use, elements 58 are set to said end operating position and teeth 67 are inserted inside initial comblike end portion 37 of plate 35. Plate 66 also comprises two folding elements or plates 71, which extend over the end teeth 67 of plate 66, are located in respective planes crosswise to surface 69, and cooperate with, and provide for squarely folding, tabs 10 of each blank 2.

Operation of unit 1 will now be described as of when a pocket 17 and a pocket 29 are aligned with each other in direction 34 at station 13, and a product 4, housed inside respective seat 21, and a respective blank 2 are fed respectively by wheel 15 and conveyor 24 to station 13, so that blank 2 is located in said prefolding position.

As of the above condition, head 44 and plate 51 are moved towards each other in direction 34 by respective actuators 46 and 53 to clamp product 4 inside seat 21, and clamp blank 2 on top of product 4 by pressing panel 6 of blank 2 onto surface 55 of product 4, and using product 4 itself as a reaction element to prevent any deformation of panel 6 or respective intermediate portion 5.

At the same time head 44 and plate 51 are moved towards product 4, devices 59 move respective comblike plates 66 in direction 34 from said end operating position towards pocket 17; and, once blank 2 is clamped as described above, devices 59 move respective plates 66 still further towards each other and towards pocket 17, so that surfaces 68 of teeth 67 contact lateral panels 8 and respective tabs 10 of blank 2, and, sliding in contact with panels 8 and tabs 10, partly fold panels 8 and tabs 10 about respective primary bend lines 9 and onto beveled longitudinal edges 20 of pocket 17.

Once panels 8 and tabs 10 are brought by teeth 67 into substantial contact with respective edges 20, thus causing blank 2 to yield along primary bend lines 9, head 44 and plate 51 are again activated to expel product 4 from respective seat 21, while still maintaining respective blank 2 clamped on product 4, and to transfer product 4, in direction 34, into pocket 29 arrested at station 13. During transfer, plates 66 are maintained with respective teeth 67 contacting respective panels 8 and tabs 10, and move away from pocket 17 in direction 34 until product 4 is expelled from respective seat 21.

Once product 4 is fully expelled, plates 66 move towards each other to finish fold panels 8 and tabs 10 about respective primary bend lines 9, and move into said end operating position in such a manner as to keep panels 8 and tabs 10 contacting respective surfaces 56 and 57 of product 4 as product 4 is inserted inside respective pocket 29. Once product 4 is housed inside pocket 29, the upper surfaces 69 of plates 66 are aligned with lateral surface 50 of product 4, and respective teeth 67 are inserted inside initial comblike end portion 37 of plate 35.

At this point, elements 58 move towards each other and towards pocket 29 to insert respective teeth 67 inside cavities 49 and, by means of plates 71, to fold tabs 10 about respective secondary bend lines 11 and onto the small lateral surfaces 56 of product 4. At the same time teeth 67 are inserted inside cavities 49, pusher 42 is withdrawn from pocket 29 back into the withdrawn idle position to enable wheel 15 to feed another product 4 into station 13.

Once tabs 10 are folded, wheel 26 moves respective product 4 one step forward along path P into channel 36, and brings a vacant pocket 29 up to station 13 to receive a further product 4.

As product 4 and respective blank 2 are fed in steps along path P, said folding devices located along path P complete the folding of blank 2 to form respective package 3, which is unloaded off packing wheel 26 at unloading station 39 by a known unloading device 72, which feeds package 3 through a frame 73 located outside wheel 26 at station 39 and defining the input of a known output conveying device (not shown).

Clamping panel 6 of blank 2 between plate 51 and respective product 4 therefore prevents any deformation of blank 2 as lateral panels 8 are folded about respective primary bend lines 9. Moreover, insertion of product 4 inside pocket 29 is simplified by manipulating elements 58, which provide not only for gradually folding panels 8 and tabs 10, but also for preventing panels 8 from being damaged by striking the end edges of walls 33.

We claim:

1. A method of folding a rigid packing blank (2) along preformed primary and secondary bend lines (9, 11) and about a respective product, (4) substantially shaped as a parallelepipedon having a pair of small parallel lateral surfaces (56) and a pair of large parallel surfaces (55), said primary and secondary preformed bend lines (9, 11) defining, on said blank (2), an intermediate portion (5) comprising a central panel (6), two lateral portions (7) arranged on either side of the intermediate portion (5) and connected to said intermediate portion (5) said primary bend lines (9), and, for each lateral portion (7), a lateral panel (8) and at least one foldable tab (10) connected to the lateral panel (8) along said secondary bend lines (11); the method comprising feeding said blank (2) and said product (4) in phase with each other to a prefolding station (13), wherein the product (4) is housed within a supply pocket (17); clamping together the blank (2) and the product (4) in a given folding position within the supply pocket, in which said central panel (6) is positioned contacting a respective said large lateral surface (55), by means of clamping means (40) engaging the product (4) and the central panel (6); prefolding said lateral portions (7) about the respective primary bend lines (9) and an to bevelled edges (20) of the supply pocket (17) by means of movable manipulating means (58) while said product and said blank are clamped by said clamping means; transferring the blank (2) and the product (4) clamped together from the supply pocket (17) to a respective folding pocket (29) by moving the clamping means (40) in a transfer direction (34) perpendicular to the central panel (6); and completing the folding of the lateral portions (7) about the respective primary bend lines (9) and on to respective said small lateral surfaces (56) during said transferring of the blank (2) and product (4) clamped together.

2. A method as claimed in claim 1, wherein, in the course of said step of transferring conveying said lateral panels (8), said product (4) is transferred in a given direction (34), together with the respective blank (2) is transferred in said transfer direction (34) from a supply pocket (17) for supplying the product (4), to a folding pocket (29) for folding the blank (2 said supply and folding pockets (17, 29) are aligned with each other in said transfer direction (34).

3. A method as claimed in claim 2, further comprising bending said foldable tab (10) about the respective second bend line (11); said bending being performed at the end of said transferring.

4. A method as claimed in claim 3, wherein each lateral portion (7) comprises two foldable tabs (10) located at opposite ends of the respective lateral panel (8); at least one of said two tabs (10) being folded squarely about the respective secondary bend line (11) in the course of said bending.

5. A method as claimed in claim 3, wherein each lateral portion (7) comprises two foldable tabs (10) located at opposite ends of the respective lateral panel (8); both said tabs (10) being folded squarely about the respective secondary bend lines (11) in the course of said bending.

6. A unit (1) for folding a rigid packing blank (2) along preformed primary and secondary bend lines (9, 11) and about a respective product (4) substantially shaped as a parallelepipedon having a pair of small parallel lateral surfaces (56) and a pair of large parallel surfaces (55), said primary and secondary preformed bend lines (9, 11) defining, on said blank (2), an intermediate portion (5) comprising a central panel (6), two lateral portions (7) arranged on either side of the intermediate portion (5) and connected to said intermediate portion (5) along said primary bend lines (9), and, for each lateral portion (7), a lateral panel (8) and at least one foldable tab (10) connected to the lateral panel (8) along secondary said bend lines (11); the unit comprising supply means (12) including a supply pocket (17) having bevelled outer edges (20) and adapted to accommodate said product (4), said supply means being provided for feeding said blank (2) and said product (4) in phase with each other to a prefolding station (13); clamping means (40) located at said station (13) for clamping said blank (2) and said product (4) in a given folding position within the supply pocket in which said central panel (6) is rigidly clamped between the clamping means (40) and one of said large lateral surfaces (55); movable manipulating means (58) for prefolding said lateral portions (7) about the respective first bend lines (9) on to said bevelled outer edges (20) while said product and said blank are clamped by said clamping means; folding means (14) comprising a folding pocket (29); and actuating means (46, 53) associated with said clamping means (40) for moving said clamping means (40) in a transfer direction (34) perpendicular to said central panel (6), and transferring said product (4) and said blank (2) clamped together from said supply pocket (17) to said folding pocket (29) in said transfer direction (34).

7. A unit as claimed in claim 6, wherein said supply means (12) comprises a supply wheel (15) having a number of said supply pockets (17), and for arresting each supply pocket (17) at said prefolding station (13) to supply a respective product (4) to said station (13); said folding means (14) comprising a packing wheel (26) having a number of said folding pockets (29), and for feeding the folding pockets (29) along a packing path (P) extending through said prefolding station (13), and arresting each folding pocket (29) at the prefolding station (13) and in a position aligned with a respective supply pocket (17) in a given direction (34).

8. A unit as claimed in claim 7, wherein each supply pocket (17) is defined y a substantially rectangular frame comprising two large lateral walls (19) having respective said bevelled outer edges (20), and two small lateral walls (18) crosswise to the large lateral walls (19) and defining, with the large lateral walls (19), a seat (21) for conveying a respective product (4); said seat (21) having a rear opening (22) by which to insert a respective product (4), and a front opening (23) by which to expel the product (4).

9. A unit as claimed in claim 8, wherein said clamping means (40) comprising a pusher (42) and a counter-pusher (43) movable in push-pull manner with respect to each other in said direction (34) and through said openings (22, 23) in the supply pockets (17) and through a central opening (31) formed through a bottom wall (30) of each folding pocket (29); the counter-pusher (43) having a clamping plate (51) positionable facing said front opening of a supply pocket (17) to clamp said central panel (6) between the clamping plate (51) and said large lateral surface (55) of a product (4) housed inside a respective said seat (21).

10. A unit as claimed in claim 9, further comprising activating means (59) for activating the manipulating means (58), and for moving the manipulating means (58) in said direction (34) onto said lateral panels (8) to fold the lateral panels (8) squarely, and between a given number of folding positions ranging between an end operating position in which the manipulating means (58) are positioned close to each other at a folding pocket (29), and an intermediate operating position, in which the manipulating means (58) are located on either side of a supply pocket (17) aligned with a respective folding pocket (29).

11. A unit as claimed in claim 10, wherein said manipulating means (58) comprise two comblike plates (66) for folding respective lateral panels (8); and, for each plate (66), at least one folding element (71) located laterally on and over the respective plate (66), and cooperating with said tab (10) to fold the tab (10) squarely about the respective secondary bend line (11) and onto an end surface (57) of the respective product (4) housed inside said folding pocket (29).

12. A unit as claimed in claim 11, wherein said lateral portions (7) comprise, for each lateral panel (8), two foldable tabs (10) located at opposite ends of the respective lateral panel (8); said manipulating means (58) comprising at least two folding elements (71) located laterally on the respective plate (66) and cooperating with the tabs (10) of at least one lateral panel (8) to fold the tabs (10) squarely about the respective secondary bend lines (11).

13. A unit as claimed in claim 11, wherein said lateral portions (7) comprise, for each lateral panel (8), two foldable tabs (10) located at opposite ends of the respective lateral panel (8); said manipulating means (58) comprising, for each plate (66), two folding elements (71) located on opposite sides of the respective plate (66) and cooperating with the tabs (10) of said lateral panels (8) to fold the tabs (10) squarely about the respective bend lines (11).

14. A unit as claimed in claim 11, wherein said pusher (42) comprises a head (44) having a flat surface (48) cooperating with a further large lateral surface (50) of said product (4) to expel the product (4) from the respective seat (21), and in turn having two numbers of cavities (49) formed at respective longitudinal ends of the head (44) and engaged in sliding manner by respective teeth (67) of said comblike plates (66) in said end operating position.

* * * * *